US006880833B2

(12) United States Patent
Polanco

(10) Patent No.: US 6,880,833 B2
(45) Date of Patent: Apr. 19, 2005

(54) MODULAR ROLLER SKATE APPARATUS

(76) Inventor: Manuel Polanco, Calle 151 No 20-57 Bloque 3, Apt. 201 Conjunto Residencial CAPRI 1, Bogota, Columbia (CO)

( * ) Notice: Subject to any disclaimer, the term of this patent is extended or adjusted under 35 U.S.C. 154(b) by 23 days.

(21) Appl. No.: 10/352,538

(22) Filed: Jan. 28, 2003

(65) Prior Publication Data

US 2004/0145129 A1 Jul. 29, 2004

(51) Int. Cl.[7] ..... A63C 17/06

(52) U.S. Cl. ..... 280/11.221; 280/11.231; 280/11.223

(58) Field of Search ..... 280/11.19, 11.204, 280/11.205, 11.221, 11.231, 11.27, 11.223; 36/50.1; 301/5.301, 5.305, 5.309

(56) References Cited

U.S. PATENT DOCUMENTS 3,193,950 A * 7/1965 Shu-Lien ..... 36/50.1
3,427,020 A * 2/1969 Montour et al. ..... 482/105
3,546,796 A * 12/1970 Adam ..... 36/102
3,900,203 A * 8/1975 Kukulowicz ..... 280/11.205
3,999,772 A * 12/1976 Brennan ..... 280/11.233
4,153,303 A * 5/1979 Tanner ..... 301/64.706
4,218,098 A 8/1980 Burton
4,666,168 A * 5/1987 Hamill et al. ..... 280/11.209
5,028,058 A 7/1991 Olson
5,092,614 A * 3/1992 Malewicz ..... 280/11.232
5,277,437 A * 1/1994 Moats ..... 280/11.223
5,308,152 A 5/1994 Ho
5,362,075 A * 11/1994 Szendel ..... 280/11.223
5,374,072 A * 12/1994 Landers ..... 280/11.27
RE35,493 E * 4/1997 Horton ..... 280/11.206
5,733,015 A * 3/1998 Demarest et al. ..... 301/5.307
5,749,215 A * 5/1998 Harrison et al. ..... 57/337
5,765,841 A * 6/1998 Johnson et al. ..... 280/11.224
5,765,928 A 6/1998 Wilkerson
5,810,369 A * 9/1998 Wilder et al. ..... 280/11.231
5,873,600 A 2/1999 Conway
6,045,144 A * 4/2000 Wong ..... 280/11.26
6,082,746 A 7/2000 Wrike
6,170,837 B1 * 1/2001 Ross ..... 280/1
6,176,554 B1 * 1/2001 Huang ..... 301/5.7
6,293,564 B1 * 9/2001 Gabrielli ..... 280/11.224
6,301,771 B1 * 10/2001 Benoit ..... 29/557
6,305,103 B1 * 10/2001 Camargo ..... 36/50.1
6,308,965 B1 * 10/2001 Yang ..... 280/11.221
6,398,231 B1 * 6/2002 Colonese ..... 280/11.223
6,491,309 B1 * 12/2002 Sheldon ..... 280/11.27
6,588,771 B1 * 7/2003 Olson et al. ..... 280/11.221
6,655,747 B1 * 12/2003 Young et al. ..... 301/5.301
6,679,560 B1 * 1/2004 van Egeraat ..... 301/5.306

* cited by examiner

*Primary Examiner*—Christopher P. Ellis
*Assistant Examiner*—Kelly E Campbell
(74) *Attorney, Agent, or Firm*—Dale J. Ream

(57) ABSTRACT

A modular roller skating apparatus includes a frame having a pair of interchangeable frame portions. A plurality of wheel assemblies is axially mounted to the frame in an in-line configuration, each assembly having a pair of releasably coupled hub portions. When coupled, the hub defines a female receptacle for detachably coupling to a corresponding male structure of a tire such that worn tires may be conveniently replaced without replacing an entire wheel assembly. A boot having a lower portion for receiving a skater's foot is releasably mounted atop the frame and includes conventional lacing. An upper boot portion is provided for surrounding a skater's ankle. Laterally spaced eyelets along respective edges of upper and lower portions enable another lace to adjustably connect the boot portions and, more particularly, to provide enhanced support to a skater's ankle and leg.

18 Claims, 6 Drawing Sheets

MODULAR ROLLER SKATE APPARATUS

BACKGROUND OF THE INVENTION

This invention relates generally to in-line roller skates and, more particularly, to a modular roller skating apparatus having an enhanced boot structure, modular frame portions, and a plurality of modular wheel assemblies.

Although in-line skates are a very popular form of exercise and entertainment, consumers have limited choices regarding the aesthetic appearance of the skates and limited ability to replace certain parts that wear out relatively quickly. More particularly, in-line skaters frequently desire to personalize their skates by making different portions of the skate different colors. In addition, skaters desire the ability to replace roller skate tires without replacing the entire wheel assembly or the entire skate. While assumably effective for their intended purposes, existing devices do not provide the modularity and ease of use that are necessary to provide maximum skater utility.

Therefore, it is desirable to have a modular roller skating apparatus having an advanced boot configuration which provides independent support structures for a skater's feet and ankles. Further, it is desirable to have a modular roller skating apparatus which includes modular frame portions that may be interchangeably replaced. In addition, it is desirable to have a modular roller skating apparatus which includes a modular wheel construction in which skate tires may be conveniently replaced without replacing the entire wheel assembly.

SUMMARY OF THE INVENTION

A modular roller skating apparatus according to the present invention includes a two-part boot structure that may be releasably coupled to a two-part modular frame structure. Each boot includes a lower portion and an upper portion, each portion including eyelets for receiving respective laces. One lace enables the upper and lower portions to be adjustably connected together. The apparatus also includes a plurality of wheel assemblies. Each wheel assembly includes a modular hub having first and second hub portions that are detachably coupled so as to sandwich a tire therebetween. In addition, a male structure on the tire may be detachably coupled to a female receptacle formed by a radial surface when the hub portions are coupled together. The present invention may be presented as a kit to enable a skater to efficiently and economically construct a pair of in-line skates according to desired colors. The present design further provides cost and time savings by allowing individual parts to be replaced quickly and easily.

Therefore, a general object of this invention is to provide a roller skating apparatus having a modular construction.

Another object of this invention is to provide a roller skating apparatus, as aforesaid, which provides a lower boot portion for supporting a skater's foot and a detached upper boot portion for supporting a skater's ankle and lower leg.

Still another object of this invention is to provide a roller skating apparatus, as aforesaid, having a modular frame with interchangeable frame portions.

Yet another object of this invention is to provide a roller skating apparatus, as aforesaid, having a plurality of modular wheel assemblies that are individually removable from the frame.

A further object of this invention is to provide a roller skating apparatus, as aforesaid, in which each wheel assembly may be disassembled for removing and replacing a worn tire.

A still further object of this invention is to provide a roller skating apparatus, as aforesaid, which enables a user to economically and efficiently assemble and maintain a roller skate.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
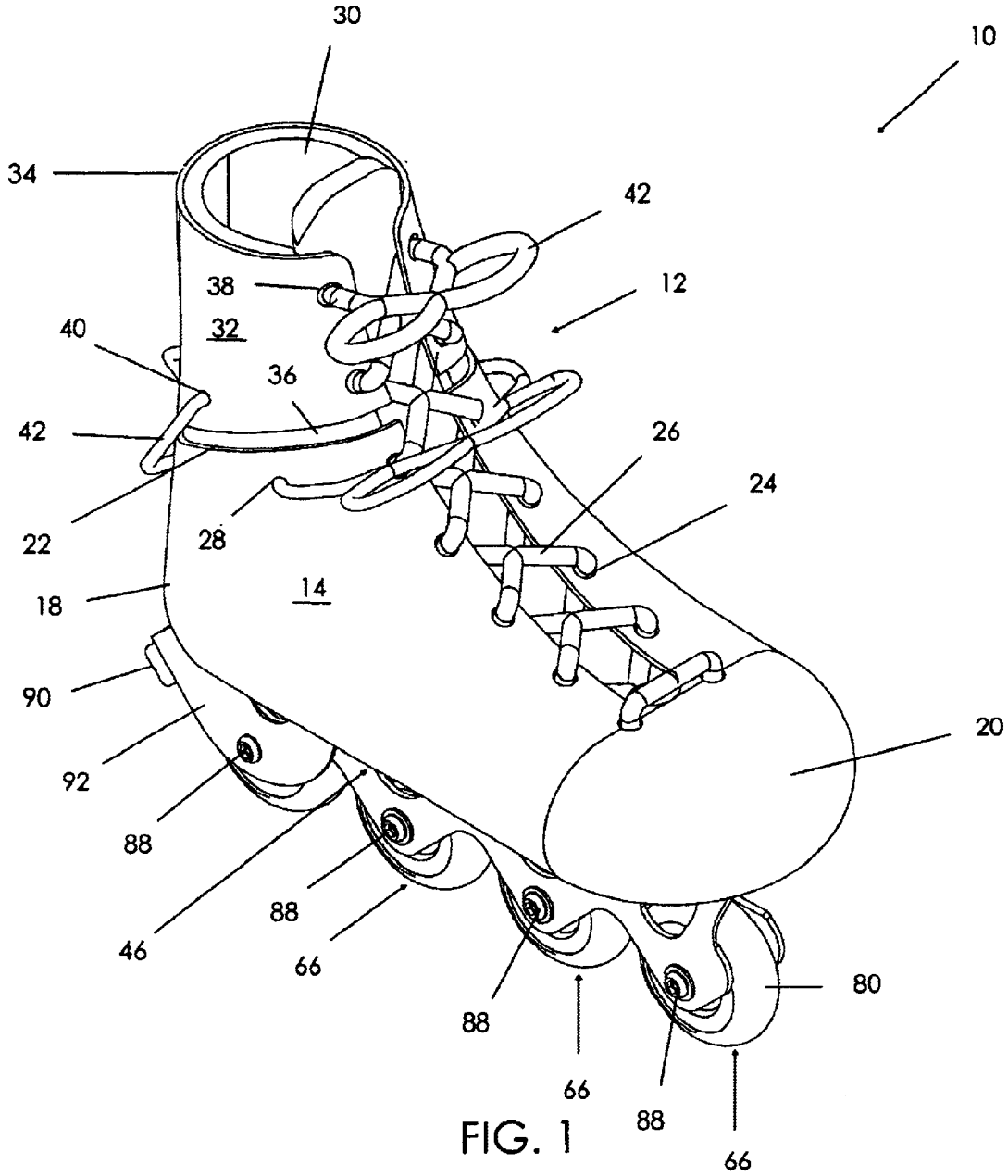
FIG. 1 is perspective view of a modular roller skating apparatus according to one embodiment of the present invention.

A modular roller skating apparatus according to the present invention will now be described in detail with reference to FIGS. 1 through 6 of the accompanying drawings. A roller skating apparatus 10 according to one embodiment of the invention is shown in FIG. 1 and includes a boot 12 mounted to a frame 44 with a plurality of roller wheel assemblies 66 rotatably mounted to the frame 44 (FIG. 1).

More particularly, the boot 12 includes a lower portion 14 having opposed heel 18 and toe 20 ends and a sole 16 extending therebetween (FIG. 1). The lower portion 14 further includes an upper edge 22 defining an opening for receiving a skater's foot into the lower portion 14. The lower portion 14 includes a longitudinal extent extending between the toe end 20 and the upper edge 22, the longitudinal extent including side wall edges having a first set of lower portion eyelets 24 positioned along its side edge. A first lace 26 may be drawn through the first set of lower portion eyelets 24 so as to adjustably tighten or loosen the lower portion 14 about a skater's foot. A second set of lower portion eyelets 28 are laterally spaced apart adjacent the upper edge 22 of the lower portion 14 for receiving another lace therethrough, as to be more fully described below. An inner boot liner 30 may be situated within the lower portion 14 and extend upwardly through the opening formed by the upper edge 22.

The boot 12 further includes an upper portion 32 that is separate from the lower portion 14 (FIG. 1). The upper portion 32 includes opposed upper 34 and lower 36 edges defining an open top and bottom for receiving a skater's foot therethrough such that the upper portion 32 may surround a skater's ankle in use. The upper portion 32 includes a first set of upper portion eyelets 38 along its frontal longitudinal extent and includes a second set of upper portion eyelets 40 adjacent its lower edge 36. The second set of upper portion eyelets correspond with the second set of lower portion eyelets 28. A second lace 42 may be drawn through the second sets of lower and upper portion eyelets 28, 40 so as to connect the lower 14 and upper 32 portions together, respectively. The second lace 42 may be further drawn through the first set of upper portion eyelets 38 so as to adjustably tighten or loosen the upper portion 32 about the skater's ankle. Having upper 32 and lower 14 boot portions connected only by laces provides a skater with more control over support adjustments for enhanced skating performance, comfort, and injury prevention.

Figure 2:
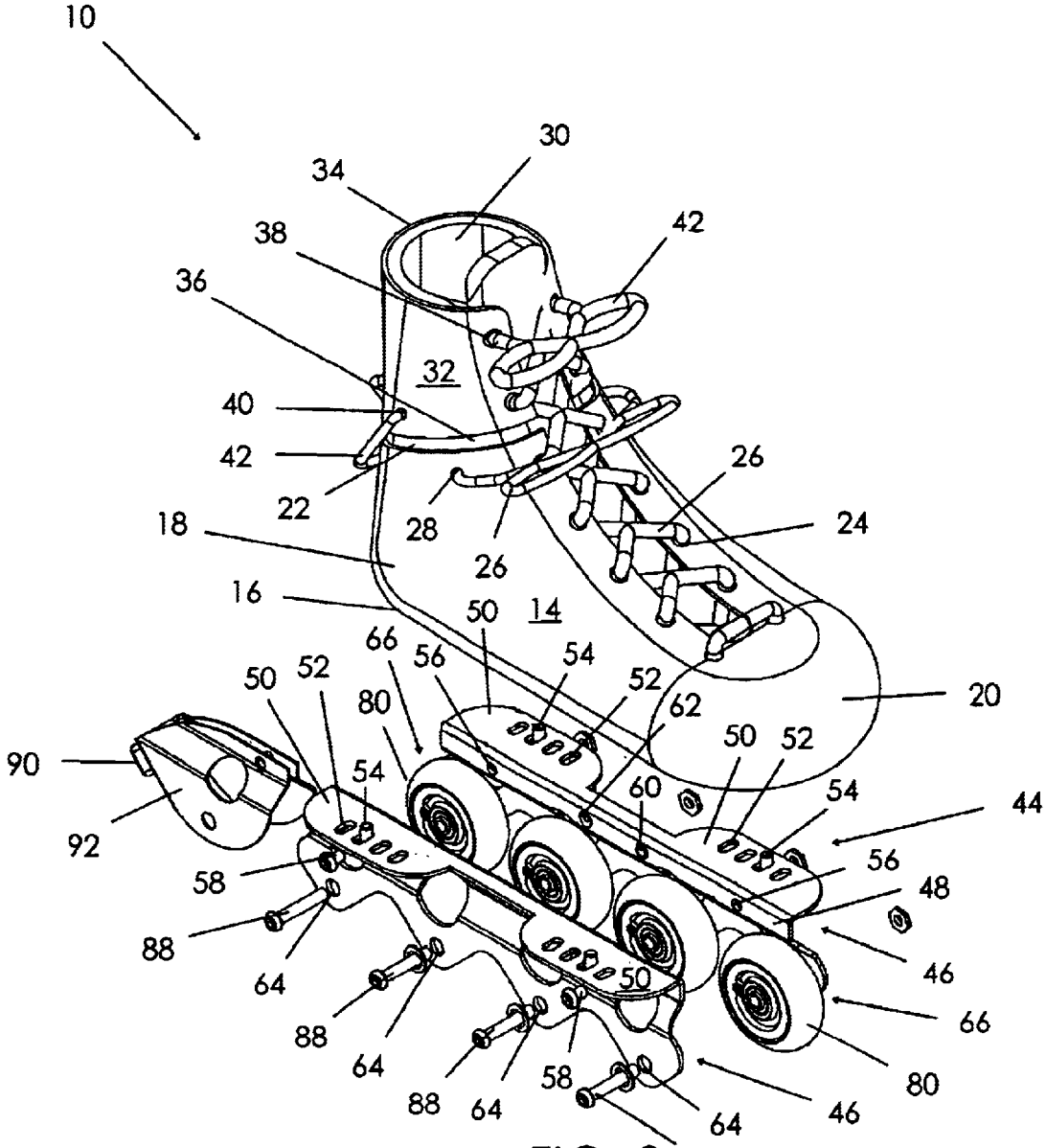
FIG. 2 is an exploded view of the apparatus as in FIG. 1.

Preferably, the frame 44 of the apparatus 10 includes a pair of frame portions 46 having substantially similar constructions and are, therefore, referred to using the same reference numerals (FIG. 2). Each frame portion 46 includes a symmetrical configuration between opposed ends and each frame portion 46 is a mirror image of the other frame portion. Therefore, the frame portions are interchangeable with each other or with another frame portion, for example, with a frame portion of another color.

More particularly, each frame portion 46 includes a generally upstanding side wall 48 and at least one flange 50 integrally connected to the side wall 48 and extending outwardly therefrom. Preferably, each side wall 48 includes a pair of spaced apart flanges 50 each flange being adjacent a respective frame portion end although a single flange centrally situated would also work. Each flange 50 is generally perpendicular to the side wall 48 and presents a planar surface upon which the sole 16 of the lower portion 14 of the boot 12 may be supported. Each flange 50 defines a plurality of apertures 52 such that the boot lower portion 14 may be mounted to a flange 50 with frame fasteners 54 at a selectable forward or backward position. This construction enables the frame portions 46 to be fastened to boots having different designs or configurations, such as boots made by different manufacturers.

Further, the side wall 48 defines a pair of spaced apart attachment apertures 56 such that the pair of frame portions may be releasably coupled together with fasteners 58 such as bolts, screws, or the like. Inner surfaces of the side wall 48 include a pair of spaced apart dimples 60, 62. One of the dimples 60 includes a convex configuration while another of the dimples 62 includes a concave configuration such that the pair of frame portions 46 may be held in proper alignment when fastening them together.

The side wall 48 of each frame portion 46 also includes an outwardly sloped/offset configuration (FIG. 2) such that the plurality of wheel assemblies 66 may be mounted in between the pair of frame portions 46, as to be described more fully below. Each side wall 48 also defines a plurality of wheel apertures 64 (FIG. 2) corresponding to the wheel assemblies 66 through which respective axial wheel fasteners 88 may be inserted (FIG. 3) and about which respective wheel assemblies 66 may rotate. Therefore, the wheel assemblies 66 may be rotatably mounted in an in-line configuration between the frame portions 46.

Figure 4B:
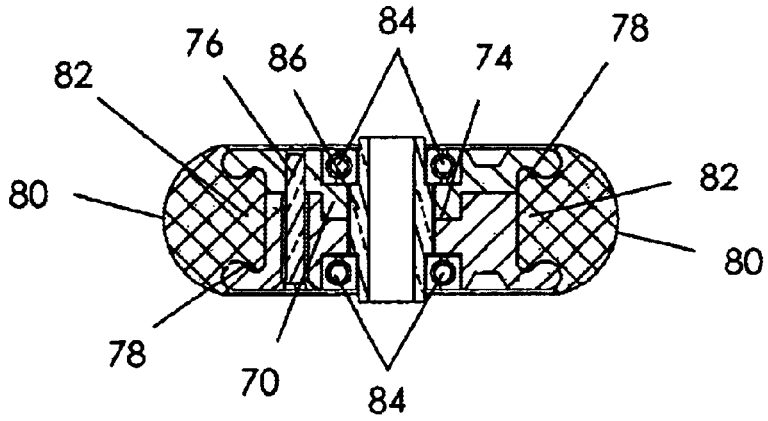
FIG. 4B is a sectional view taken along line 4B—4B of FIG. 4A.
Figure 4A:
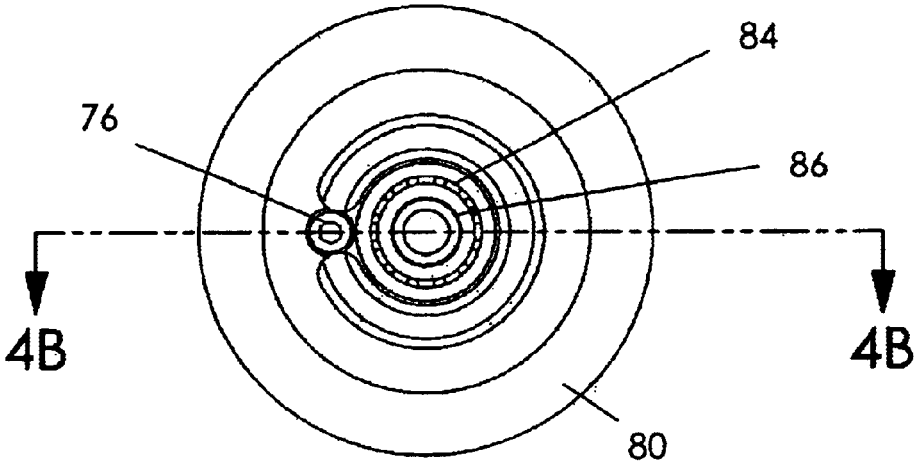
FIG. 4A is a front view of a wheel assembly removed from the apparatus as in FIG. 1.
Figure 5:
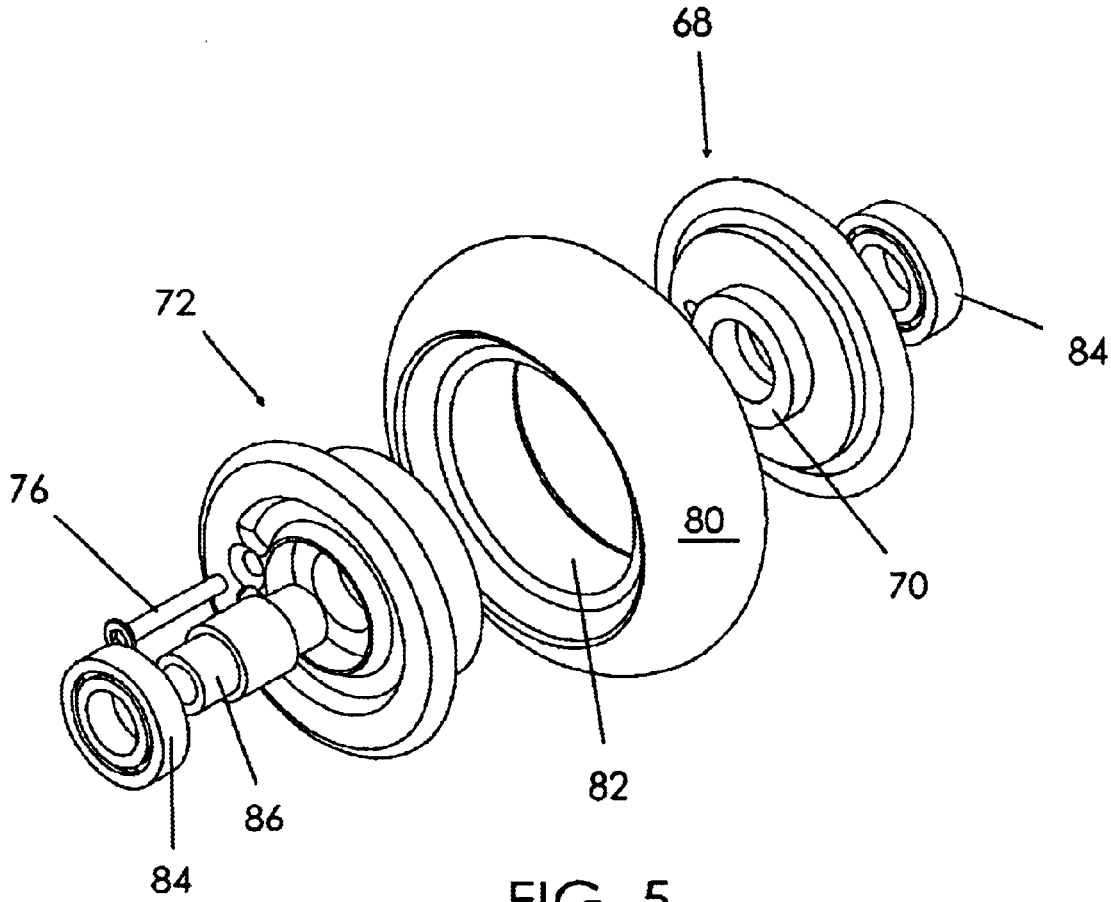
FIG. 5 is an exploded view of the wheel assembly as in FIG. 4A.

Each wheel assembly 66 of the modular roller skating apparatus 10 includes a hub having a first hub portion 68 and a second hub portion 72 (FIG. 5). More particularly, the first hub portion 68 includes a male attachment structure 70 and the second hub portion 72 includes a female attachment structure 74 for detachably coupling with the male attachment structure 70. In other words, the hub portions present complementary configurations for being releasably coupled together. The hub portions may be held together with a hub bolt 76 or other similar fastener. When coupled together, the first 68 and second 72 hub portions form an outer radial surface defining a female receptacle 78 (FIG. 4B). Each wheel assembly 66 includes a tire 80, an inner surface of which forms a male attachment member 82 for detachably coupling with the female receptacle 78 (FIG. 4B). In addition, each wheel assembly 66 may include bearings 84 such that axial fasteners 88 are able to rotate the hub portions 68, 72 and tire 80. A spacer 86 may also be provided in each wheel assembly 66 for efficient assembly and operation.

Figure 3:
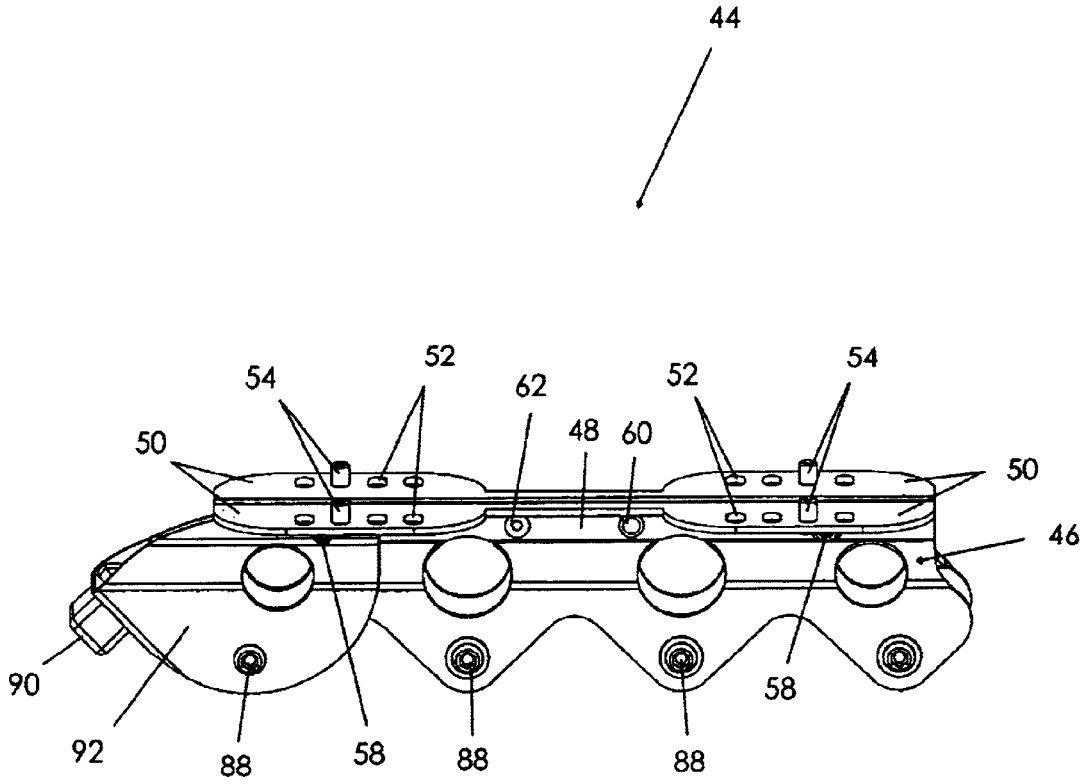
FIG. 3 is a perspective view of a frame removed from the apparatus as in FIG. 1.

A brake pad 90 is coupled to a brake assembly bracket 92 (FIG. 3). The brake assembly bracket 92 may be mounted either to a front or rear end of the symmetrical frame portions 46 using respective attachment fasteners 58 and axial fasteners 88.

In use, a modular roller skate apparatus 10 according to the present invention may be pre-assembled at a point-of-purchase or be presented as a kit for assembly by the user. The pair of frame portions 46 may be releasably coupled together to form a singular frame. As the frame portions 46 are symmetrical and interchangeable, existing frame portions may be quickly and easily replaced with other frame portions 46, e.g. such as with frame portions of other colors. The brake assembly bracket 92 with the brake pad 90 may be mounted to either end of a respective pair of frame portions 46. If not already coupled, the plurality of wheel assemblies 66 may be rotatably mounted between side walls 48 of the pair of frame portions 46. Skate tires endure a hard life as they are subjected to the forces of accelerating, braking, and turning. In the present invention, individual wheel assemblies 66 may be removed so as to replace worn tires 80. Thus, only the tires need to be replaced while the wheel hubs may be reused again and again. Removal and replacement thereof is made easy by the male/female attachment structures of the hub portions and tires.

If a boot lower portion 14 is not already mounted, one may be mounted atop the coupled frame portions at a desired frontward or backward position. A skater may slide his foot through a boot upper portion 32 and into a boot lower portion 14. The first lace 26 may be drawn to tighten the lower portion 14 about the skater's foot and the second lace 42 may be drawn to connect the upper 32 and lower 36 boot portions together as well as to tighten the upper portion 32 about the skater's ankle. The ability to adjust the upper 32 and lower 14 boot portions independently provides enhanced ankle and lower leg support to the skater. The modular construction of the apparatus 10 enables a skater to personalize the apparatus 10 with components having desired colors as well as to repair and replace components quickly and easily.

It should be appreciated that the construction described above would also be suitable in the form of an ice skate. More particularly, an ice skate blade may be mounted to the frame portions rather than the plurality of wheel assemblies 66.

Figure 6:
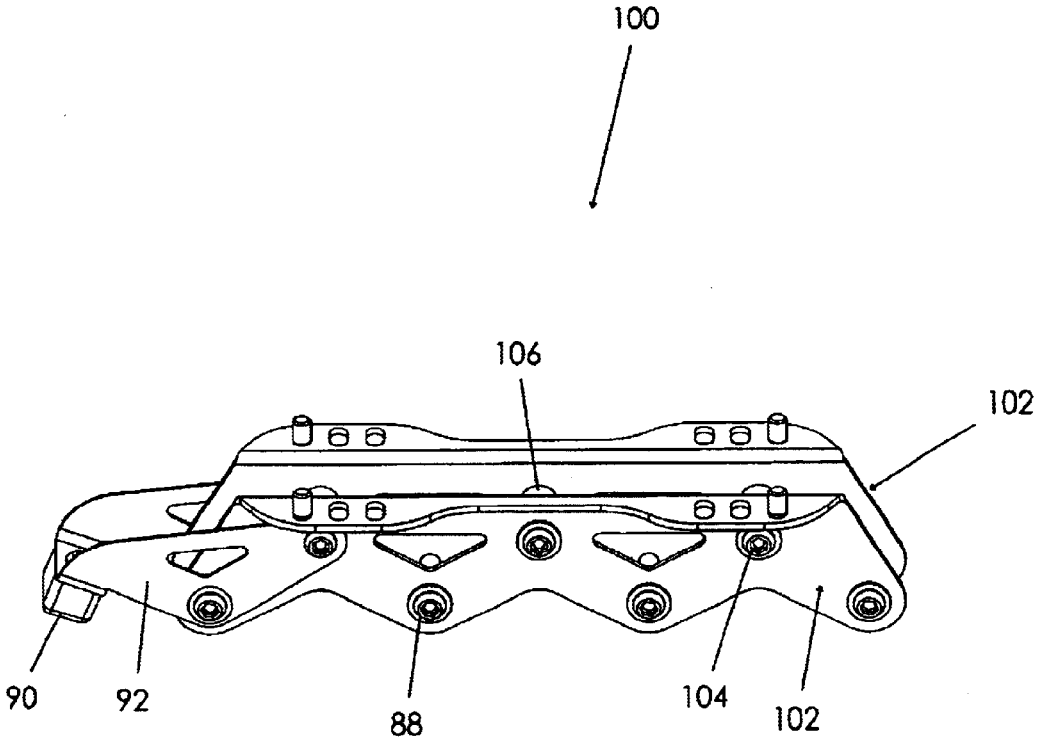
FIG. 6 is a perspective view of a frame of a roller skating apparatus according to another embodiment of the present invention.

A modular roller skate apparatus according to another embodiment of the present invention includes a construction that is substantially similar to the construction described previously except as otherwise described below. The frame 100 of this apparatus is shown in FIG. 6 and includes a pair of frame portions 102 that are coupled together with frame bolts 104, the frame bolts being inserted through cylindrical spacers 106. The spacers 106 hold the frame portions 102 a predetermined distance from one another, making it unnecessary for the frame portion side wall to have sloped configuration to accommodate a plurality of wheel assemblies therebetween. It should be appreciated that the configuration of this embodiment allows the frame to have a lower profile and a simpler and smaller construction.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A modular roller skate assembly usable by a skater on a skating surface, comprising:

a frame;

a plurality of wheel assemblies, each wheel assembly including a hub having a central axis of wheel rotation and having a tire mounted to said hub, said plurality of wheel assemblies being axially mounted to said frame and positioned in an in-line configuration;

a boot having a lower portion mounted atop said frame for receiving a skater's foot and an upper portion for surrounding the skater's ankle;

wherein said lower portion defines a first set of lower portion eyelets spaced apart along a longitudinal extent thereof and a second set of lower portion eyelets laterally spaced apart adjacent an upper edge of said lower portion of said boot;

wherein said upper portion defines a first set of upper portion eyelets spaced apart along a longitudinal extent thereof and a second set of upper portion eyelets laterally spaced apart adjacent a lower edge of said upper portion of said boot;

a first lace extending through said first set of lower portion eyelets for tightening said lower portion about the skater's foot; and a second lace extending through said second set of lower portion eyelets and said second set of upper portion eyelets for enhancing the stability of the skater's ankle and lower leg, said second lace further extending through said first set of said upper portion eyelets for tightening said upper portion about the skater's ankle.

2. The modular roller skate assembly as in claim 1 wherein said frame includes a pair of symmetrical and interchangeable frame portions, each frame portion comprising:

at least one flange defining a planar surface for receiving a sole of said lower portion of said boot thereon, said planar surface defining a plurality of apertures for coupling said frame portion to said boot with frame fasteners at a selectable forward or backward configuration; and a side wall substantially perpendicular to said flange and extending downwardly therefrom, said side wall defining at least one attachment aperture for receiving a fastener therethrough when corresponding attachment apertures of said pair of frame portions are aligned, whereby to couple said pair of frame portions together.

3. The modular roller skate assembly as in claim 2 wherein said side wall of said each frame portion includes:

an outwardly sloped configuration for enabling said plurality of wheel assemblies to be rotatably mounted between said pair of frame portions;

a plurality of wheel apertures corresponding to said plurality of wheel assemblies through which axial wheel fasteners may be extended; and a pair of spaced apart dimples, one of said pair of dimples having a convex configuration and another of said pair of dimples having a concave configuration for maintaining symmetrical alignment of said pair of frame portions.

4. The modular roller skate assembly as in claim 1 further comprising:

a brake pad; and means for selectively mounting said brake pad to a front or rear end of said frame.

5. The modular roller skate assembly as in claim 1 further comprising a plurality of wheel axles corresponding to said plurality of wheel assemblies, each wheel axle being coupled to a corresponding wheel hub for rotation thereof about a respective central axis.

6. The modular roller skate assembly as in claim 1 wherein said hub includes a first hub portion having a configuration complementary to a configuration of a second hub portion such that said first and second hub portions are releasably coupled together for sandwiching said tire therebetween in a friction-fit engagement.

7. The modular roller skate assembly as in claim 6 wherein:

an inner surface of said tire includes a male attachment structure; and said first and second hub portions form a radial surface defining a female receptacle for detachably coupling with said male attachment structure of said tire when said first and second hub portions are coupled together.

8. The modular roller skate assembly as in claim 1 wherein:

an inner surface of said tire includes a male attachment structure;

said hub defines a female receptacle for detachably coupling with said male attachment structure of said tire.

9. A modular roller skate assembly usable by a skater, comprising:

a frame including a pair of symmetrical and interchangeable frame portions, each frame portion comprising:

at least one flange defining a planar surface for receiving a sole of said lower portion of said boot thereon, said planar surface defining a plurality of apertures for coupling said frame portion to said boot with frame fasteners at a selectable forward or backward configuration; and a side wall substantially perpendicular to said flange and extending downwardly therefrom, said side wall defining at least one attachment apertures for receiving a fastener therethrough when corresponding attachment apertures of said pair of frame portions are aligned, whereby to couple said pair of frame portions together, wherein said side wall includes:

an outwardly sloped configuration for enabling said plurality of wheel assemblies to be rotatably mounted in between said pair of frame portions;

a plurality of wheel apertures corresponding to said plurality of wheel assemblies through which axial wheel fasteners may be extended; and a pair of spaced apart dimples, one of said pair of dimples having a convex configuration and another of said pair of dimples having a concave configuration for maintaining symmetrical alignment of said pair of frame portions;

a boot mounted atop said frame for receiving a skater's foot therein;

a plurality of modular wheel assemblies, each wheel assembly including:

a first hub portion having a male attachment structure and a second hub portion having a female attachment structure for detachably coupling with said male attachment structure, said first and second hub portions forming an outer radial surface defining a female receptacle when said first and second hub portions are coupled;

a tire having an inner surface forming a male attachment member for detachably coupling with said female receptacle formed by said first and second hub portions;

means for axially mounting said wheel assemblies to said frame in an in-line configuration, each hub having a central axis of rotation about which a corresponding wheel assembly may rotate.

10. The modular roller skate assembly as in claim 9 wherein:

said boot includes a lower portion mounted atop said frame for receiving a user's foot and an upper portion for surrounding the skater's ankle;

said lower portion defines a first set of lower portion eyelets spaced apart along a longitudinal extent thereof and a second set of lower portion eyelets laterally spaced apart adjacent an upper edge of said lower portion of said boot; and said upper portion defines a first set of upper portion eyelets spaced apart along a longitudinal extent thereof and a second set of upper portion eyelets laterally spaced apart adjacent a lower edge of said upper portion of said boot.

11. The modular roller skate assembly as in claim 10 further comprising:

a first lace extending through said first set of lower portion eyelets for tightening said lower portion about the skater's foot; and a second lace extending through said second set of lower portion eyelets and said second set of upper portion eyelets for enhancing the stability of the skater's ankle and lower leg, said second lace further extending through said first set of said upper portion eyelets for tightening said upper portion about the skater's ankle.

12. The modular roller skate assembly as in claim 11 wherein said frame includes a pair of symmetrical and interchangeable frame portions, each frame portion comprising:

at least one flange defining a planar surface for receiving a sole of said lower portion of said boot thereon, said planar surface defining a plurality of apertures for coupling said frame portion to said boot with frame fasteners at a selectable forward or backward configuration; and a side wall substantially perpendicular to said flange and extending downwardly therefrom, said side wall defining at least one attachment aperture for receiving a fastener therethrough when corresponding attachment apertures of said pair of frame portions are aligned, whereby to couple said pair of frame portions together.

13. The modular skate assembly as in claim 12 wherein said side wall of each frame portion includes:

an outwardly sloped configuration for enabling said plurality of wheel assemblies to be rotatably mounted between said pair of frame portions;

a plurality of wheel apertures corresponding to said plurality of wheel assemblies through which axial wheel fasteners may be extended; and a pair of spaced apart dimples, one of said pair of dimples having a convex configuration and another of said pair of dimples having a concave configuration for maintaining symmetrical alignment of said pair of frame portions.

14. The modular roller skate assembly as in claim 9 further comprising:

a brake pad; and means for selectively mounting said brake pad to a front or rear end of said frame.

15. A roller skating kit for use by a skater, comprising:

a pair of frame portions, each frame portion having a symmetrical configuration and being a mirror-image of the other of said pair of frame portions, whereby said pair of frame portions are interchangeable;

wherein said each frame portion includes at least one flange having a planar surface;

wherein said each frame portion includes a side wall substantially perpendicular to said planar surface of said at least one flange and extending downwardly therefrom, said side wall defining at least one attachment aperture for receiving a fastener therethrough when corresponding attachment apertures of said pair of frame portions are aligned, whereby to couple said pair of frame portions together;

a plurality of wheel assemblies, each wheel assembly including a hub having a center axis of wheel rotation and having a tire mounted to said hub, said plurality of wheel assemblies being axially mounted to said pair of frame portions and positioned in an in-line configuration;

a boot having a lower portion releasably mounted atop said planar surface of said at least one flange of each frame portion for receiving the skater's foot therein, said boot having an upper portion detached from said lower portion for surrounding the skater's ankle;

wherein said lower portion of said boot defines a first set of lower portion eyelets spaced apart along a longitudinal extent thereof and a second set of lower portion eyelets laterally spaced apart adjacent an upper edge of said lower portion of said boot;

wherein said upper portion of said boot defines a first set of upper portion eyelets spaced apart along a longitudinal extent thereof and a second set of upper portion eyelets laterally spaced apart adjacent a lower edge of said upper portion of said boot;

a first lace extending through said first set of lower portion eyelets for tightening said lower portion about the skater's foot; and a second lace extending through said second set of lower portion eyelets and said second set of upper portion eyelets for enhancing the stability of the skater's ankle and lower leg, said second lace extending through said first set of said upper portion eyelets for tightening said upper portion about the skater's ankle.

16. The roller skating kit as in claim 15 wherein each side wall of said pair of frame portions includes:

an outwardly sloped configuration for enabling said plurality of wheel assemblies to be rotatably mounted between said pair of frame portions;

a plurality of wheel apertures corresponding to said plurality of wheel assemblies through which axial wheel fasteners may be extended; and a pair of spaced apart dimples, one of said pair of dimples having a convex configuration and another of said pair of dimples having a concave configuration for maintaining symmetrical alignment of said pair of frame portions.

17. The roller skating kit as in claim 15 wherein:

said hub includes a first hub portion having a configuration complementary to a configuration of a second hub portion such that said first and second hub portions are releasably coupled together;

when coupled together, said first and second hub portions define a female receptacle; and an inner surface of said tire includes a male attachment structure for detachably coupling with said female receptacle of said first and second hub portions.

18. The roller skating kit as in claim 15 further comprising:

a brake pad; and means for selectively mounting said brake pad to respective front or rear ends of said pair of frame portions.

* * * * *